United States Patent [19]

Trotta

[11] 4,354,312

[45] Oct. 19, 1982

[54] SHAVING IMPLEMENT, HOUSING THEREFOR, AND RAZOR

[75] Inventor: Robert A. Trotta, Winthrop, Mass.

[73] Assignee: The Gillette Company, Boston, Mass.

[21] Appl. No.: 194,551

[22] Filed: Oct. 6, 1980

[51] Int. Cl.[3] ..... B26B 21/14

[52] U.S. Cl. ..... 30/47; 30/50

[58] Field of Search ..... 30/47, 50, 51, 84, 30, 30/31

[56] References Cited

U.S. PATENT DOCUMENTS

| | | | |
|---|---|---|---|
| 1,195,259 | 8/1916 | O'Reilly . | |
| 1,337,435 | 4/1920 | Brown . | |
| 2,374,612 | 4/1945 | Mellon | 30/84 X |
| 2,488,436 | 11/1949 | Santoro | 30/30 |
| 2,800,713 | 7/1957 | Roth | 30/32 |
| 3,892,036 | 7/1975 | Perry | 30/62 |
| 3,918,155 | 11/1975 | Atkins | 30/47 |
| 4,026,016 | 5/1977 | Nissen | 30/47 |
| 4,069,580 | 1/1978 | Cartwright | 30/47 |
| 4,272,885 | 6/1981 | Ferraro | 30/47 |

FOREIGN PATENT DOCUMENTS

| | | |
|---|---|---|
| 57383 | 1/1975 | Australia . |
| 2746372 | 4/1978 | Fed. Rep. of Germany . |
| 3012690 | 10/1980 | Fed. Rep. of Germany . |

*Primary Examiner*—Jimmy C. Peters

*Attorney, Agent, or Firm*—Scott R. Foster

[57] ABSTRACT

A shaving implement housing including a platform portion, and a cap portion overlying the platform portion, the platform portion having a series of aligned recesses therein, the cap portion comprising a series of spaced, aligned fingers, each of the fingers being disposed over one of the recesses, the recesses being separated by platform rib portions, the rib portions and the fingers being adapted to receive and retain a blade therebetween. A shaving implement including a housing as above described and a blade disposed between the fingers and rib portions and presenting a cutting edge. A razor including the shaving implement above described fixed to a handle having a grip portion.

8 Claims, 9 Drawing Figures

SHAVING IMPLEMENT, HOUSING THEREFOR, AND RAZOR

BACKGROUND OF THE INVENTION

1. Field of the Invention

The invention relates to wet shaving systems and is directed more particularly to a low-cost highly maneuverable wet shaving device.

2. Description of the Prior Art

It is generally known in the art to provide a housing having platform and cap portions adapted to receive a blade means therebetween. In U.S. Pat. No. 1,195,259, issued Aug. 22, 1916 to W. E. O'Reilly, there is shown a platform and cap portion formed from a single piece of metal, the cap overlying the platform.

It is also generally known to embed a blade in a plastic shaving head, the head being permenently attached to a handle, or alternatively, removable from a handle for replacement by another shaving head. U.S. Pat. No. 1,864,995, issued June 28, 1932 to T. H. Frost shows such an arrangement.

More recent examples of plastic shaving heads having blades fixed therein include U.S. Pat. Nos. 3,703,764, issued Nov. 28, 1972 to Roger L. Perry, 3,724,070 issued Apr. 3, 1973 to Francis W. Dorion, and 4,026,016 issued May 31, 1977 to Warren I. Nissen. While such recent examples have been eminently successful, there is as always, a need for such products which are less expensive to manufacture and offer improved functional characteristics.

A combination of the simplicity of the O'Reilly device and the more recent blade-in-plastic shaving implements would afford significant cost savings, and at the same time permit manufacture of a more maneuverable, more easily handled shaving implement.

SUMMARY OF THE INVENTION

It is therefore an object of the present invention to provide a shaving implement housing adapted to receive blade means between cap and platform portions which operate to retain the blade means without need of rivet portions, or the like.

A further object of the invention is to provide a shaving implement including the above housing and a blade means disposed between the cap and platform portions and retained therebetween.

A still further object of the invention is to provide a razor including the above shaving implement and a handle fixed thereto, the handle having a grip portion for manual manipulation of the razor during a shaving operation.

With the above and other objects in view, as will hereinafter appear, a feature of the present invention is the provision of a shaving implement housing comprising a platform portion, a back portion upstanding from a lengthwise margin of said platform portion, a cap portion extending from said back portion and overlying said platform portion, leg portions extending forwardly from said platform portion and joining a guard portion, said platform portion having a series of aligned recesses therein adjacent said back portion, and said cap portion comprising a series of spaced, aligned, forwardly extending fingers, each of said fingers being disposed over one of said recesses, said recesses being separated by platform rib portions, said rib portions and said fingers being adapted to receive and retain blade means therebetween.

In accordance with a further feature of the invention, there is provided a shaving implement including the housing above described and a blade means disposed between the fingers and the rib portions, the blade means presenting cutting edge means between the guard portion and the cap portion.

In accordance with a still further feature of the invention, there is provided a razor including the shaving implement above described and a handle member fixed to the implement and having a grip portion facilitating the referred to manual manipulation of the razor during a shaving operation.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown illustrative embodiments of the invention from which its novel features and advantages will be apparent.

In the drawings.

DESCRIPTION OF THE PREFERRED EMBODIMENTS

Figure 1:
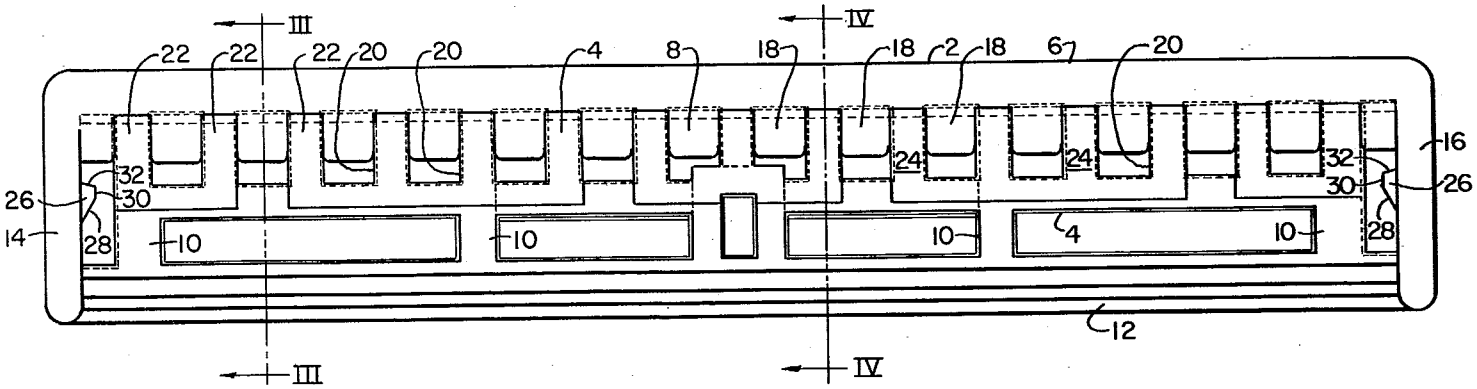
FIG. 1 is a top plan view of one form of housing illustrative of an embodiment of the invention.

Referring to the drawings, and particularly FIGS. 1–4, it will be seen that an illustrative housing 2 includes a platform portion 4. A back portion 6 upstands from a lengthwise margin of the platform portion 4, and a cap portion 8 extends forwardly from the back portion 6 to overlie the platform portion. The housing further includes leg portions 10 extending forwardly from the platform portion and joining a guard portion 12 which is disposed parallel to the back portion 6. The housing is further provided with end walls 14, 16 interconnecting the back and guard portions at the ends of the housing.

The cap portion 8 comprises a series of spaced, aligned, forwardly extending fingers 18. The platform portion is provided with a series of spaced, aligned recesses 20, the recesses being separated by platform rib portions 22. As may be seen in FIG. 1, each of the fingers 18 is disposed over one of the recesses 20 and each of the rib portions 22 is in alignment with a space between two of the fingers 18.

Preferably, the entire housing is of molded plastic and is molded as an integral unit. The fingers 18 are in effect leaf springs adapted to flex to receive a blade means between the fingers and the platform and further serve to urge the blade means against an upper surface 24 of the platform portion.

Figure 2:
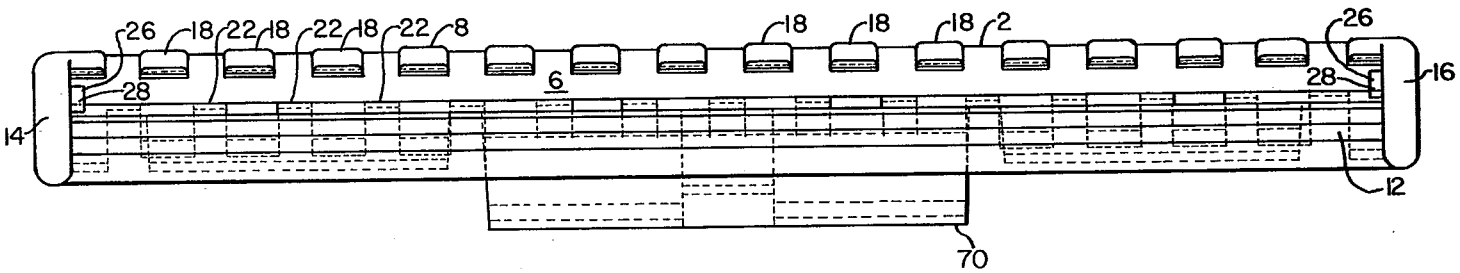
FIG. 2 is a front elevational view thereof.
Figure 4:
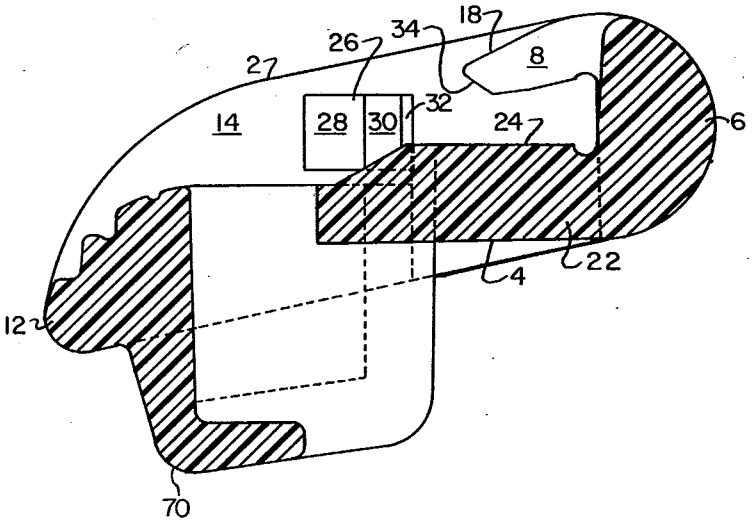
FIG. 4 is a sectional view taken along line IV—IV of FIG. 1.
Figure 3:
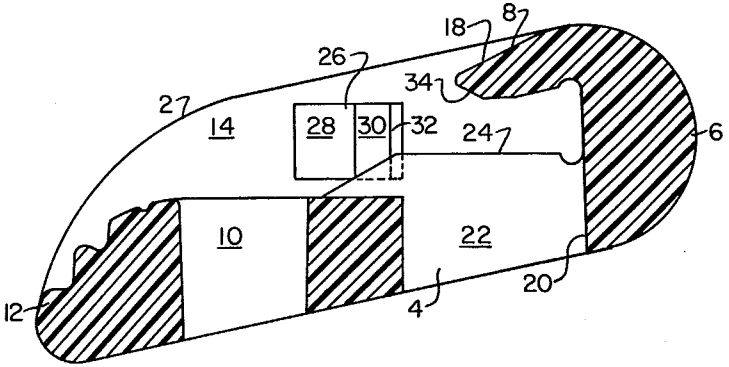
FIG. 3 is a sectional view taken along line III—III of FIG. 1.

In the preferred embodiment, the end walls 14, 16 are provided with inwardly extending projections 26 which are opposed to each other, as seen in FIGS. 1 and 2. The projections provide an additional blade means retention facility. Each projection includes a forward surface 28 extending from the end wall on which the projection is mounted obliquely to a side surface 30. A rear surface 32 interconnects the rearward edge of the side surface and the end wall surface. The function and operation of the projections 26 will be further described hereinbelow.

Each of the fingers 18 includes a guide surface 34, serving to guide a blade means into the gap, or pocket, formed by the platform and back portions and the fingers. The fingers 18 are formed such that while extending forwardly, the fingers also extend slightly downwardly, as viewed in FIGS. 3 and 4, or toward the platform surface 24.

Figure 5:
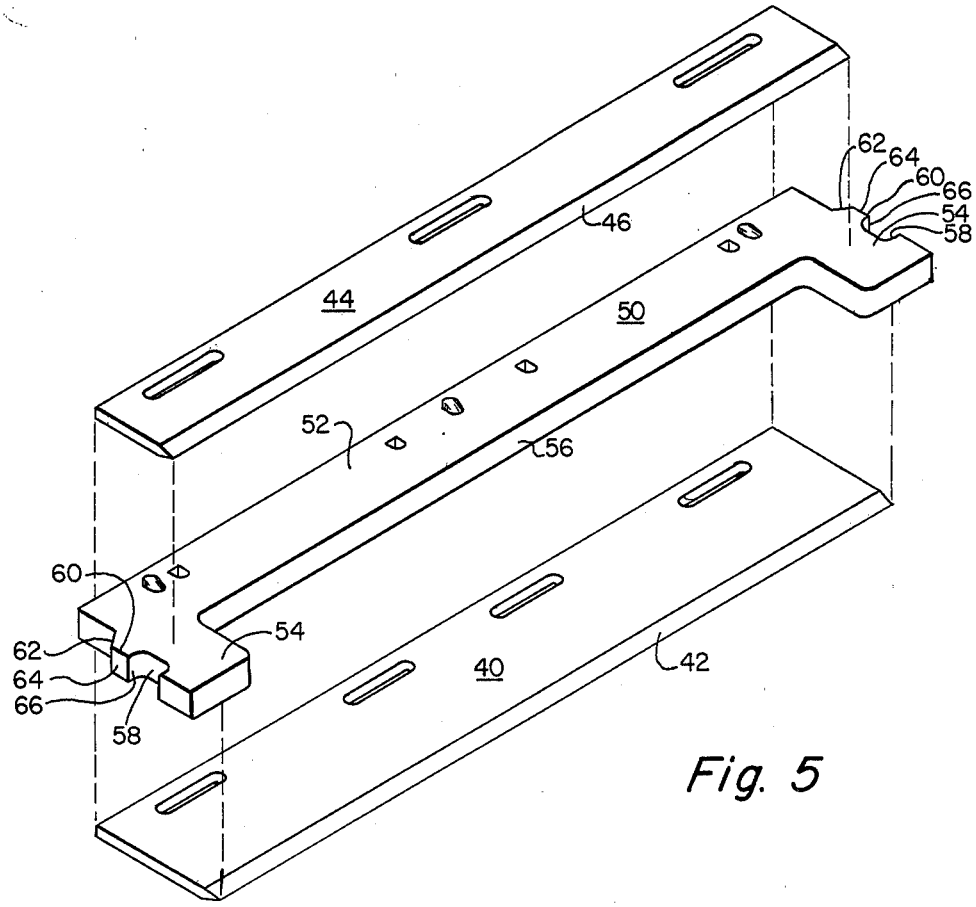
FIG. 5 is an exploded perspective view of an illustrative blade means.

Referring to FIG. 5, it will be seen that a blade means suitable for use with the above-described housing includes a first blade 40 having a cutting edge 42 and a narrower second blade 44 having a cutting edge 46, the blades 40, 44 being disposed on either side, respectively, of a spacer member 50. The spacer member 50 includes an elongated central portion 52 and end portions 54 extending forwardly of a frontal edge 56 of the central portion 52 and having outwardly-facing notches 58 therein adapted to receive the projections 26. The notches 58 are defined in part by extensions 60, each having a cam surface 62, an outer surface 64, and a notch surface 66.

Figure 6:
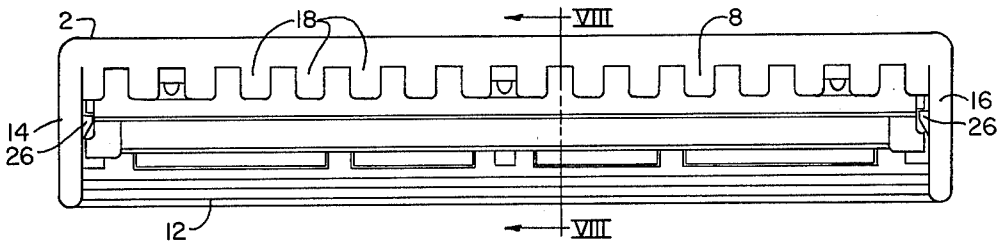
FIG. 6 is a top plan view of one form of shaving implement illustrative of a further embodiment of the invention.
Figure 7:
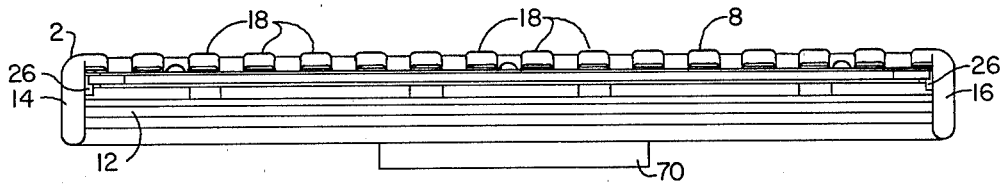
FIG. 7 is a front elevational view of the shaving implement.
Figure 8:
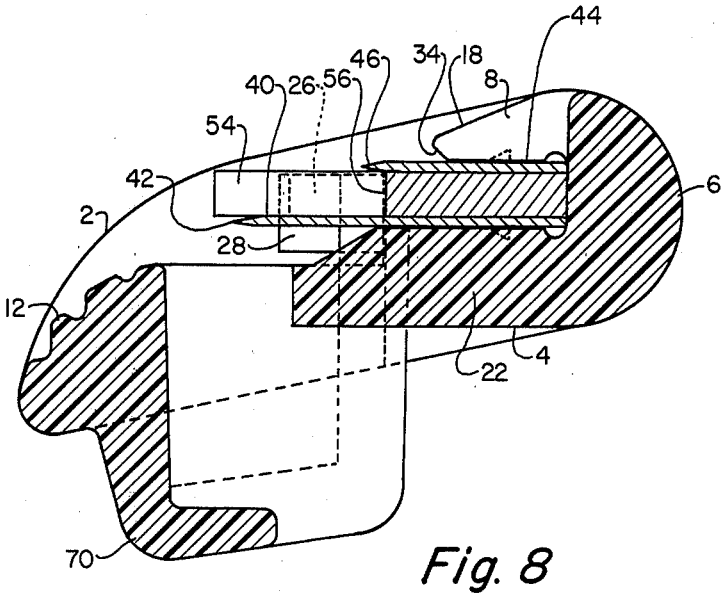
FIG. 8 is a sectional view taken along line VIII—VIII of FIG. 6.

In assembly, the blade means including the first blade 40, spacer 50, and second blade 44, is inserted between the fingers 18 and the upper surfaces 24 of the rib portions 22, the finger guide surfaces 34 guiding and urging the blade means into place. The cam surface 62 engages the projection forward surface 28. Continued pressure on the blade means causes the extensions 60 to override the projections 26, with the notches 58 coming to rest about the projections 26, as seen in FIG. 6.

Figure 9:
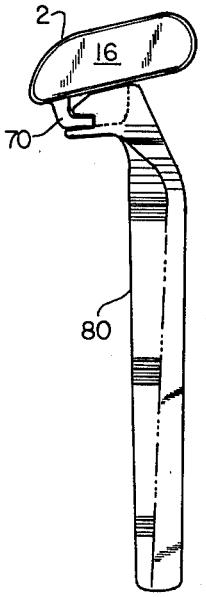
FIG. 9 is a side elevational view of one form of razor illustrative of a still further embodiment of the invention.

Referring to FIG. 9, it will be seen that the housing may be provided with means for attachment to a razor handle. While such means may comprise the well known groove means disclosed in the aforementioned U.S. Pat. No. 3,724,070, or journal bearing means as disclosed in the aforementioned U.S. Pat. No. 4,026,016, in the embodiment shown in FIGS. 1–4, the housing is provided with connecting means 70 adapted to be engaged by a razor handle 80. The handle 80 may be of the type permanently connected to the housing 2, or may be of the type selectively connected and disconnected to and from the handle.

It is to be understood that the present invention is by no means limited to the particular constructions herein disclosed and/or shown in the drawings, but also comprises any modifications or equivalents within the scope of the disclosure.

Having thus described my invention, what I claim as new and desire to secure by Letters Patent of the United States is:

1. A shaving implement housing comprising a platform portion, a back portion upstanding from a lengthwise margin of said platform portion, a cap portion extending from said back portion and overlying said platform portion, leg portions extending forwardly from said platform portion and joining a guard portion, said platform portion having a series of aligned recesses therein adjacent said back portion, and said cap portion comprising a series of spaced, aligned, forwardly extending fingers, each of said fingers being disposed over one of said recesses, said recesses being separated by platform rib portions, said rib portions and said fingers being adapted to receive and retain blade means therebetween.

2. The invention in accordance with claim 1 in which said fingers comprise spring means adapted to flex to receive said blade means and to urge said blade means against said rib portions.

3. The invention in accordance with claim 1 including end walls at each end of said housing interconnecting said platform and guard portions, each of said end walls having an inwardly extending protuberance thereon, said protuberances being opposed.

4. The invention in accordance with claim 1 including connecting means depending from said housing and adapted to interconnect with a razor handle.

5. A shaving implement comprising the housing in accordance with claim 1 and a blade means disposed between said fingers and said rib portions, said blade means presenting cutting edge means between said guard portion and said cap portion.

6. The invention in accordance with claim 5 in which said blade means comprises a first blade member, a spacer member, and a second blade member, said spacer member being disposed between said first and second blade members.

7. A razor comprising the shaving implement in accordance with claim 5 and a handle member fixed to said implement and having a grip portion facilitating manual manipulation of said razor during a shaving operation.

8. The invention in accordance with claim 1 in which each of said rib portions is in alignment with a space between two of said fingers.

* * * * *